US006116068A

United States Patent [19]

Vockentanz et al.

[11] Patent Number: 6,116,068

[45] Date of Patent: Sep. 12, 2000

[54] METHOD OF REGULATING THE DRIVE OF A DRAWING MACHINE, AND DRAWING DEVICE

[75] Inventors: Rainer Vockentanz, Schwabach; Ludwig Meggle, Marktoberdorf, both of Germany

[73] Assignee: Maschinenfabrik Niehoff GmbH & Co. KG, Schwabach, Germany

[21] Appl. No.: 09/285,359

[22] Filed: Apr. 2, 1999

[30] Foreign Application Priority Data

Apr. 7, 1998 [EP] European Pat. Off. ..... 98106352

[51] Int. Cl.[7] ..... B21C 1/10; B21C 1/12

[52] U.S. Cl. ..... 72/17.2; 72/21.4; 72/279; 72/288

[58] Field of Search ..... 72/279, 288, 280, 72/21.4, 17.2

[56] References Cited

U.S. PATENT DOCUMENTS

| | | | |
|---|---|---|---|
| 4,326,400 | 4/1982 | Davydov | 72/280 |
| 5,136,866 | 8/1992 | Lisciani | 72/288 |
| 5,628,219 | 5/1997 | Fink | 72/279 |

FOREIGN PATENT DOCUMENTS

| | | | |
|---|---|---|---|
| 0679452 A1 | 11/1995 | European Pat. Off. . | |
| 1915072 | 10/1970 | Germany | 72/279 |
| 55056036 | 4/1980 | Japan . | |
| 56081645 | 5/1981 | Japan . | |

OTHER PUBLICATIONS

"AC Drawing Machine Without Dancer Rolls;" 2455 Wire Indsutry, Oct. 1995, Surrey, Great BritaIN.

*Primary Examiner*—Daniel C. Crane
*Attorney, Agent, or Firm*—Gardner, Carton & Douglas

[57] ABSTRACT

The present invention relates to a method of regulating the drive of a multiple drawing machine or drawing device, respectively, as well as to a device for drawing billets. By means of the method it is possible to drive a wet drawing machine such that slip-free operation is also achieved. The device according to the invention comprises a drive regulation suited for slip-free wet operation. By means of the present invention, substantial improvements of the quality of the drawn product, in particular of wires of copper, copper alloys or special materials, respectively, are achieved. The operation substantially is performed automatically, and an automatic adaptation of the device to modified operating conditions, such as modification of the property of the material of the billet, is effected.

28 Claims, 4 Drawing Sheets

METHOD OF REGULATING THE DRIVE OF A DRAWING MACHINE, AND DRAWING DEVICE

BACKGROUND OF THE INVENTION

The present invention relates to a method of regulating the drive of a drawing machine or device, respectively, and to a device for drawing metal billets.

Drawing machines or devices, respectively, for drawing billets comprise a plurality of draw plates over which the billet, for instance the wire, is guided in at least one, preferably several coils and is, for the sake of reducing its cross-section, pulled through drawing dies positioned between the draw plates.

Due to the defined cross-section at the entrance of the drawing die and the defined cross-section at the exit of the drawing die, a defined extension of the wire results. In correspondence with the extension of the wire per drawing stage, the speed of rotation of the draw plates per drawing stage also has to be increased.

Due to technologically predetermined wire extensions, correspondingly designed drive gears are used, with which the corresponding differences in the speed of rotation between the individual draw plates are generated by corresponding gear ratios.

Depending on the capability of deformation of the wire material, various drawing sequences were introduced for the drawing dies in drawing technology. The wire extensions resulting from the drawing sequence have to be taken into account in the drawing machine by adapted gear ratios for the draw plates. In order to compensate for deviations in the drawing die sequence or for possible wear of drawing dies, drawing machines having a mechanical gear will operate with slip, i.e. except for the draw-off plate after the last drawing die, all draw plates will rotate too quickly relative to the wire.

This drawing method operating with slip is acceptable only with quite a few wire materials and in wet drawing only. Other materials, such as e.g. steel wire, are drawn without slip in the dry drawing method. Here, the draw plates would immediately wear out in the case of slip, and the wire would be damaged. According to the state of the art, the slip-free operation of these machines is performed by individually driven draw plates with one regulating member each, such as dancer or jockey roller, between the draw plates, or with a wire collection on the draw plates.

In order to improve the operation of a drawing machine operating in such a slide-free way, a method is suggested by EP 679 452 A1 wherein the adjusting and production operation of a multiple drawing machine is to be performed automatically, and wherein the magnitudes or signals, respectively, which are necessary for the regulating process, such as speed of the material and force, each are to be taken over by the drives from the magnitudes of speed of rotation and torque or speed of rotation and current or speed of rotation and performance, and are to be directly measured by measuring devices.

It is not the drive which is positioned last in the direction of material flow that is operated as so-called leading drive, but a speed regulating element is positioned in front of this drive which, in turn, sets a unit load nominal value at its exit which acts as load nominal value for all control and regulating devices.

This method is a very complicated one and is suited exclusively for slip-free drawing processes, i.e. only for steel wires in dry drawing.

Moreover, brakes are provided for at the drives of the draw plates of the slip-free wire drawing machines in order to avoid reversing of the draw plates after the drawing machine has been switched off.

SUMMARY OF THE INVENTION

It therefore is an object of the present invention to provide a method of slip-free drive regulation of a wet drawing machine without additional equipment such as dancers etc., by which all adjustments are performed by the machine itself by means of its regulation and are adapted to the optimum operating condition. In addition, the method is intended to be suitable in particular also for the drawing of wires and profiles of copper, copper alloys and other special materials which usually are drawn wet, and an improvement of the quality of the final product is to be achieved.

Furthermore, it is an object of the present invention to provide a device for drawing any kind of billets, in particular also of copper, copper alloys and other special materials, which can be operated at particularly high speed in slip-free operation, and which is of simple construction, with neither jockey rollers, dancers or energy absorbers nor brakes being required.

In order to achieve the slip-free operation of a drawing machine, it is not only the speed of rotation of the draw plates that has to be adapted exactly to the wire extensions of the draw plate sequence, but the torques at the draw plates also have to be controlled. Once procedure-technological modifications are performed, the torques at the draw plates will also change.

The total torques at the draw plates depend on a plurality of parameters, such as e.g. degree of deformation, friction between wire and drawing die, property of the drawing means, polish of the drawing die as well as mechanical and hydraulic power loss. The total torques thus are composed of the effective moments and the friction moments. All in all, the following context is applicable:

$$M_{total}=M_{effective}+M_{friction}$$

with $$M_{effective}=M_{deformation}+M_{drawing\ die\ friction}$$

and $$M_{friction}=M_{friction,\ mechanical}+M_{friction,\ hydraulic}.$$

With the solution according to the invention, it is further possible to collect the effective moments and the friction moments separately, to recognize modifications of the total torques and to assign the modifications to the individual torques, so that they may be re-regulated, if need be. Torque modifications resulting from wear of the drawing die or increases of the diameter of the drawing die are recognized and corrected by re-regulating the speed of rotation of the plates at the superposed draw plates, so that the slip-free operation is maintained.

In accordance with the invention, the method of regulating the drive of a drawing machine is characterized by the following steps:

automatic determination of the effective torques necessary for the deformation process at the individual drawing stages at every starting process at low and constant speed in slip operation, wherein a reference torque comparative value is formed from the effective torques of every two adjacent draw plates, collecting the effective torques at the drawing stages in slip-free production operation and forming a comparison of every two adjacent draw plates for forming a first torque comparative value each, comparing the collected first torque comparative value with the predetermined reference torque comparative value, and in the case of deviations of the current first torque comparative value from the reference torque comparative value, overlapping the regulation of the speed of rotation of the drives such that the respective slower drive modifies the speed of rotation of the pertinent draw plate until the deviation between the torque comparative values is substantially 0 again.

In accordance with the present invention, the drawing device is characterized by the regulating device automatically determining the effective torques necessary for the deforming process at the individual drawing stages at every starting process at low and constant speed in slip operation, wherein it forms a reference torque comparative value from the effective torques of every two adjacent draw plates, collecting the effective torques at the drawing stages in slip-free production operation and comparing the effective torques of every two adjacent draw plates for forming a first torque comparative value each, comparing the collected first torque comparative value with the predetermined reference torque comparative value, and on deviations of the current first torque comparative value from the reference torque comparative value, overlapping the regulation of the speed of rotation of the drives such that the respective slower drive modifies the speed of rotation of the pertinent draw plate until the deviation between the torque comparative values substantially is 0 again.

According to the present invention, the speeds of the draw plates always adapt themselves to the process or the drawing operation, respectively. In so doing, every modification at the drawing dies is regulated such that the speed of rotation of the plates always is identical to the speed of the wire.

The regulation of the method according to the invention is substantially also based on that actual values of the torques are compared with reference values. These reference values advantageously are determined and stored during starting of the machine, which is performed in slip operation. This may be done after the first revolutions of the draw plates already, the model of the torques relative to each other collected over the entire device being stored as machine model. This machine model then serves as reference value for the slip-free operation. In so doing, it is ensured that the machine model remains unmodified, and an individual regulating circuit is provided therefor, if need be.

The friction moment of every draw plate is collected as a function of the speed and automatically. This determination of the friction moment is performed once in operation without a wire, and the moment taken up by the motor at various speed stages between minimum and maximum speed is collected and stored. A so-called "friction moment characteristic curve" is automatically calculated by the drive by means of interpolation between the individual measuring data, so that a value for the friction moment exists for every speed of rotation.

When determining the effective torques at low and constant speed in slip operation, the friction moment is negligibly small, so that the torque measured at the motor corresponds to the effective torque.

The present invention has a number of considerable advantages as compared to the state of the art.

By forming torque comparative values in production operation and by means of the stored machine or device model, respectively, the device is capable of differentiating between local modifications at a particular draw plate which may be regulated by torque, and system-comprehensive modifications which do not require a regulation by torque. The device or the method, respectively, recognizes e.g. any modification of the force of deformation caused by modifications of the dimension or the quality of the wire to be drawn. In accordance with the invention, in such a case the device for drawing will on it's own learn the modified measuring data and will on it's own adjust itself to the new material.

Thus, the drawing process is performed at minimum wire load, and a maximum of surface quality of the wire is guaranteed, which was not possible so far in particular when producing copper wires, wires of copper alloys or special materials.

Since, in the case of the conventional production methods of copper wires, a power transmission operating with slip always was used, substantially less wear of the draw plates results from the method according to the invention.

Due to the drawing method of the state of the art which always was performed with slip, wire drawing devices of this kind entailed considerable noise pollution (up to 120 decibel), which often necessitated expensive sound insulation of such machines so as not to impair the working conditions. Due to the slip-free operation of the device during wire drawing, this noise is omitted, and the device according to the invention only produces noise ranging below the maximally admissible noise level of the factory, so that expensive sound insulation may be omitted.

Due to the slip-free wire drawing of copper wires and wires of copper alloys or special materials, respectively, it is also possible to produce profiles of such materials on the device according to the invention.

Another great advantage is that slip losses occurring with conventional methods operating with slip can be avoided, which results in substantial savings of energy.

Moreover, as compared to conventional methods and devices, the flexibility can be increased substantially since, due to the regulation according to the invention, the correct relation of speed of the successive drawing stages ensues by simple self-regulating adaptation for instance when skipping drawing stages. This also results in a distinctly higher availability of the device since, in case one drawing stage has to be repaired, it is not necessary to put the entire machine out of operation.

The slip-free operation of the method according to the invention is in an outstanding way achieved by the fact that the predetermined value of the slip in the stationary operation of the drawing machine is negative. The consequence is that the corresponding draw plate at any rate does not rotate more quickly than the wire rotating around it, this resulting in a distinct reduction of wear.

By the fact that the regulation of the speed of rotation of the draw plates is performed on the basis of the speed of rotation of the last draw plate, also referred to as "draw-off plate", the main nominal value, the regulation is in a simple way started or controlled, respectively, from the maximum speed of rotation of the last draw plate.

The method according to the invention is in an outstanding way suited for the operation of a wet drawing machine; due to the regulation provided, different operating conditions ranging from operation with slip to slip-free operation are possible.

Advantageously, electric motors are used as drives, and every drive is fully powered on starting of the device. This happens for instance in temporal sequence from the first to the last draw plate, subsequent to which the device is started. The process of powering is effected at very short time, so that it is ensured that the last draw plate starts to rotate first and the draw plates positioned in front of it also start to rotate in correspondence with the regulation according to the invention. In particular, a smooth, jolt-free starting of the machine becomes possible due to the measures mentioned above.

Furthermore, the powering of the motor is advantageously controlled such that the material or billet, respectively, is relaxed when the machine is stopped. No brakes or other clamping devices thus are required.

Advantageously, a distinct slip is provided for during starting, which is, however, quickly reduced strongly (for instance from 50% to 2%), with minor line speed of the billet being provided which preferably ranges below 5% of the maximum speed. In a more preferred way, this speed ranges at 2% of the maximum speed. Preferably, the reference values are collected at this minor line speed.

Already at this minor speed can all necessary parameters be collected.

Subsequently, slip-free operation is preferably changed over to, and the drawing machine or drawing device, respectively, is run up to operating speed, which again guarantees for an operating result that is of correspondingly high-grade quality.

In order to optimize a steady operation, it is provided in accordance with the invention that the predetermined slip value is equal at least for all draw plates, the speed of rotation of which is regulated as a function of the comparative value. Preferably, the negative slip value is at least −0.1%. This value ensures that no slip occurs between the draw plate and the wire, and that a steady regulation of the slip-free operation is enabled.

Particularly advantageously, the drive positioned first in drawing direction is exempted from the regulation. This again results in a stabilization of the operation since possible variations, e.g. due to a modified diameter or due to modified strength of the material to be drawn, remain unconsidered. At the moment at which a modification is ascertained at the first drive, the second drive also is switched off with respect to the load compensation regulation, as this is performed by means of the torque difference processing. If the modification is, due to a varying strength of the material to be drawn, continued from the first drive via the second drive and via the following drives, the regulation will conclude that the modifications are caused by the material and that the speed of rotation therefore does not have to be corrected. Thus, it is, however, also ensured that changes of material during welding will not influence the regulation of the drawing device.

Additionally, it is achieved with the method according to the invention that the device is self-learning, which results in a self-optimization in predetermined limits and thus in an adaptation to any new material to be drawn.

With another advantage, a measurement of the friction characteristic values is also performed for exact determination of the reference values, the friction characteristic values comprising mechanical friction such as motor, gear and sealing, or hydro friction such as splash losses in wet operation, the values being determined during idling and being stored as reference values.

In a preferred embodiment, the first torque comparative value is formed from the difference of two torques of adjacent draw plates. The first torque comparative value $\Delta M_1$ results as follows:

$$\Delta M_1 = M_i - M_{i-1}.$$

In an alternative preferred embodiment, the first torque comparative value $\Delta M_1$ is formed from the quotient of two torques of adjacent draw plates and can be calculated as follows:

$$\Delta M_1 = M_1 / M_{i-1},$$

with i being the number of the draw plate in both formulas.

The afore-mentioned advantages apply both to the method and to the device according to the invention.

BRIEF DESCRIPTION OF THE DRAWINGS

Further details, features and advantages of the invention result from the following description making reference to the enclosed drawing.

In the following, first of all the device for drawing billets according to the invention will be described, and subsequently the functioning of the device or the method according to the invention, respectively, will be described.

DETAILED DESCRIPTION OF THE PREFERRED EMBODIMENT

Figure 1:
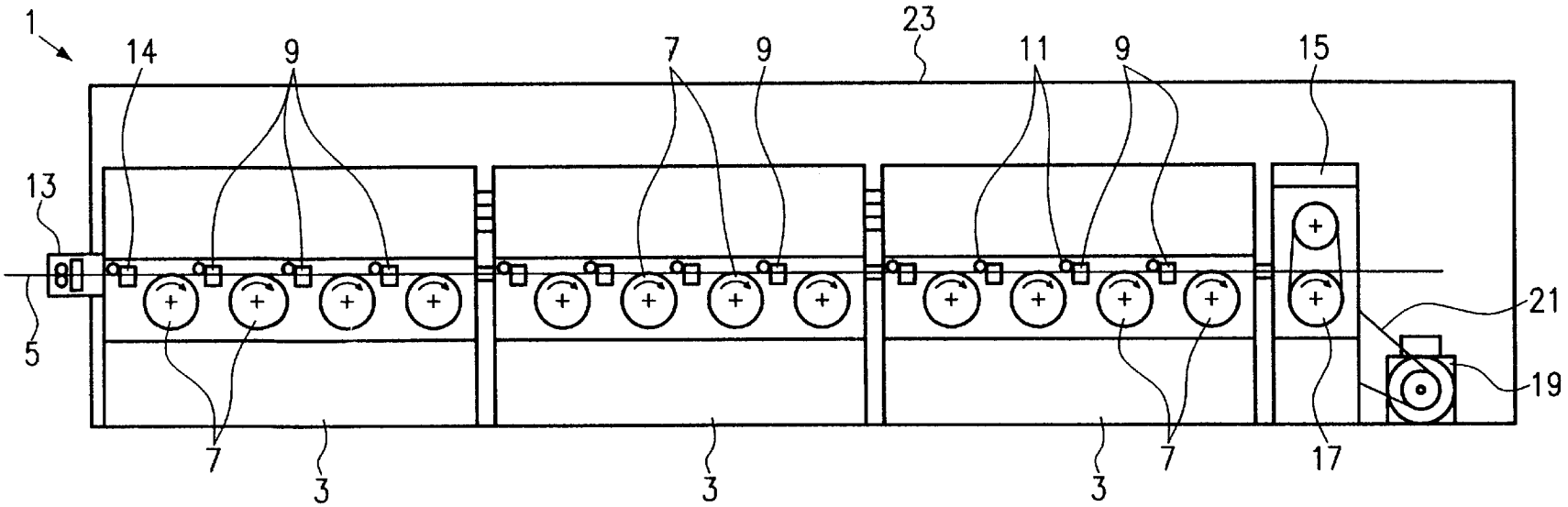
FIG. 1: shows a schematic representation of a drawing device according to the invention in lateral view.

FIG. 1 shows a device 1 for drawing wire in lateral view. The device 1 comprises three modular drawing machine portions 3 arranged successively in drawing direction of a wire 5. The advantage of the modular portions 3 of the device 1 on the one hand is the more favourable transportability of the individual portions 3 and, on the other hand, the possibility of providing less or more than three portions for a device 1 according to the invention.

Every modular portion 3 comprises four draw plates 7 with drawing dies 9 positioned therebetween. At every drawing die 9 a guide roller 11 is furthermore arranged.

The draw plates 7 are, as shown in FIG. 1, rotated clockwise, as is indicated by the arrows represented.

The wire 5 is introduced via an introducing device 13 to the first drawing die 14. Subsequently, the wire is coiled correspondingly once or several times around the first draw plate 7 and guided through the further drawing die 9.

In the device shown in FIG. 1, the wire 5 is guided around all draw plates 7 and through all drawing dies 9 or 14, respectively. As may be gathered, the direction of the wire preferably is substantially exactly straight from the first draw plate to the last draw plate.

At the end of the modular portions 3, an outlet device or station 15 is positioned, in which a draw-off plate 17 is provided as last plate.

The device 1 as shown is a wet drawing machine, the modular portions 3 being encased correspondingly in order to sealingly incorporate the coolant and lubricant sprayed in from outside.

The draw-off plate 17 is, since running dry, positioned separately for this reason.

The draw-off plate 17 is driven by a motor 19, the connection between the motor 19 and the draw-off plate shaft of the draw-off plate 17 being performed by means of a band drive 21.

Behind and spaced apart from the modular portions 3 a control and regulating device 23 is positioned which incorporates the regulating circuits and other electronic control means of the device according to the invention.

Figure 2:
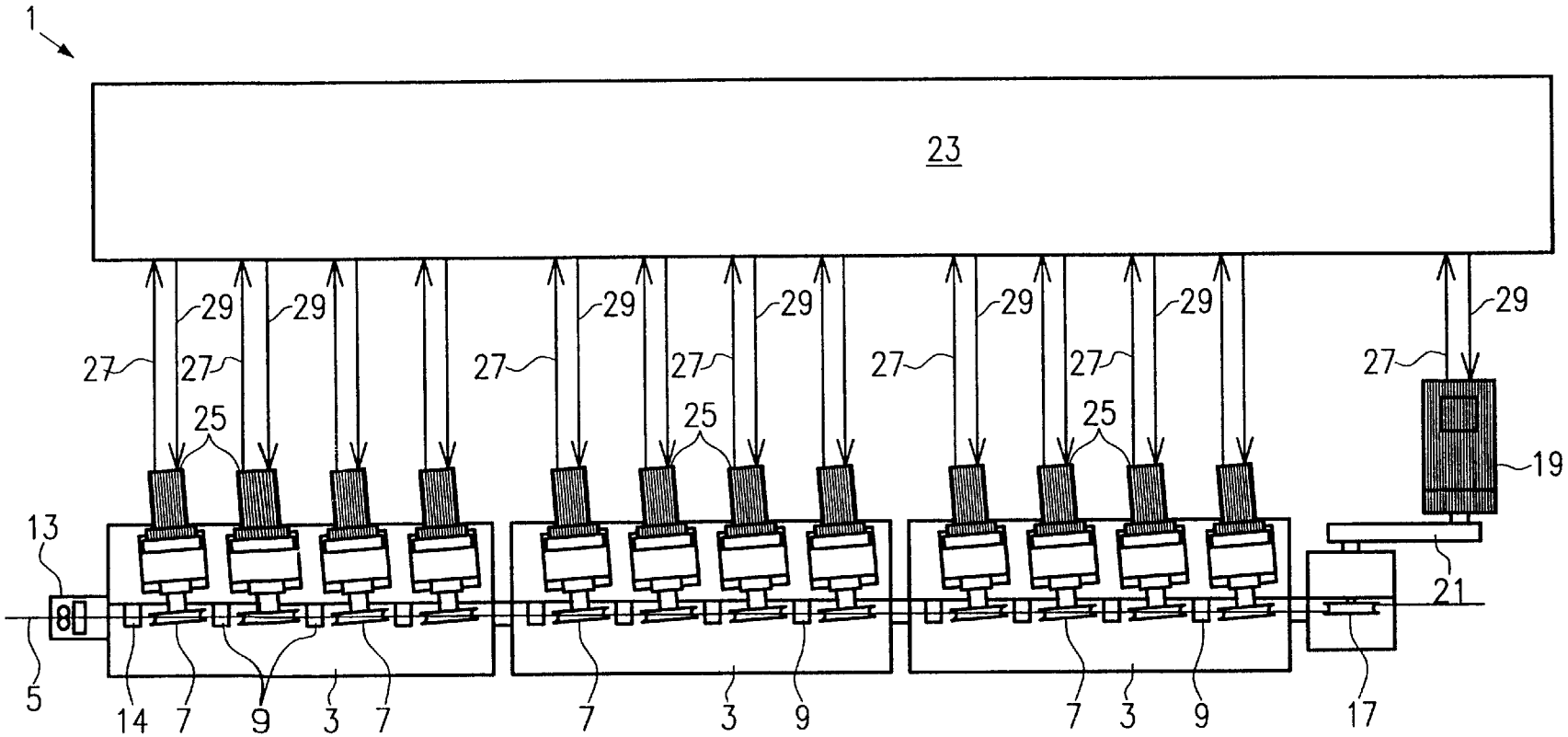
FIG. 2: shows a view from the top on the drawing device according to the invention pursuant to FIG. 1.

Now, reference is made to FIG. 2 showing a view from the top on the device 1 according to the invention shown in FIG. 1. The same elements have been provided with the same reference numbers as in FIG. 1.

As may be gathered from FIG. 2, every draw plate 7 comprises its own drive or its own drive means 25, respectively, and every drive means 25 directly drives a draw plate 7. The drive means 25 comprises an electric motor and, if necessary, an additional gear ratio drive.

Every drive means 25 and also the drive means 19 of the draw-off plate 17 comprises a connecting line 27 transmitting the signals collected by the drive means to the regulating device 23. Furthermore, for every drive means 25 or the motor 19, respectively, a connecting line 29 is provided which transmits the signals transmitted by the regulating device 23 for the corresponding drive means to this drive means.

Figure 3:
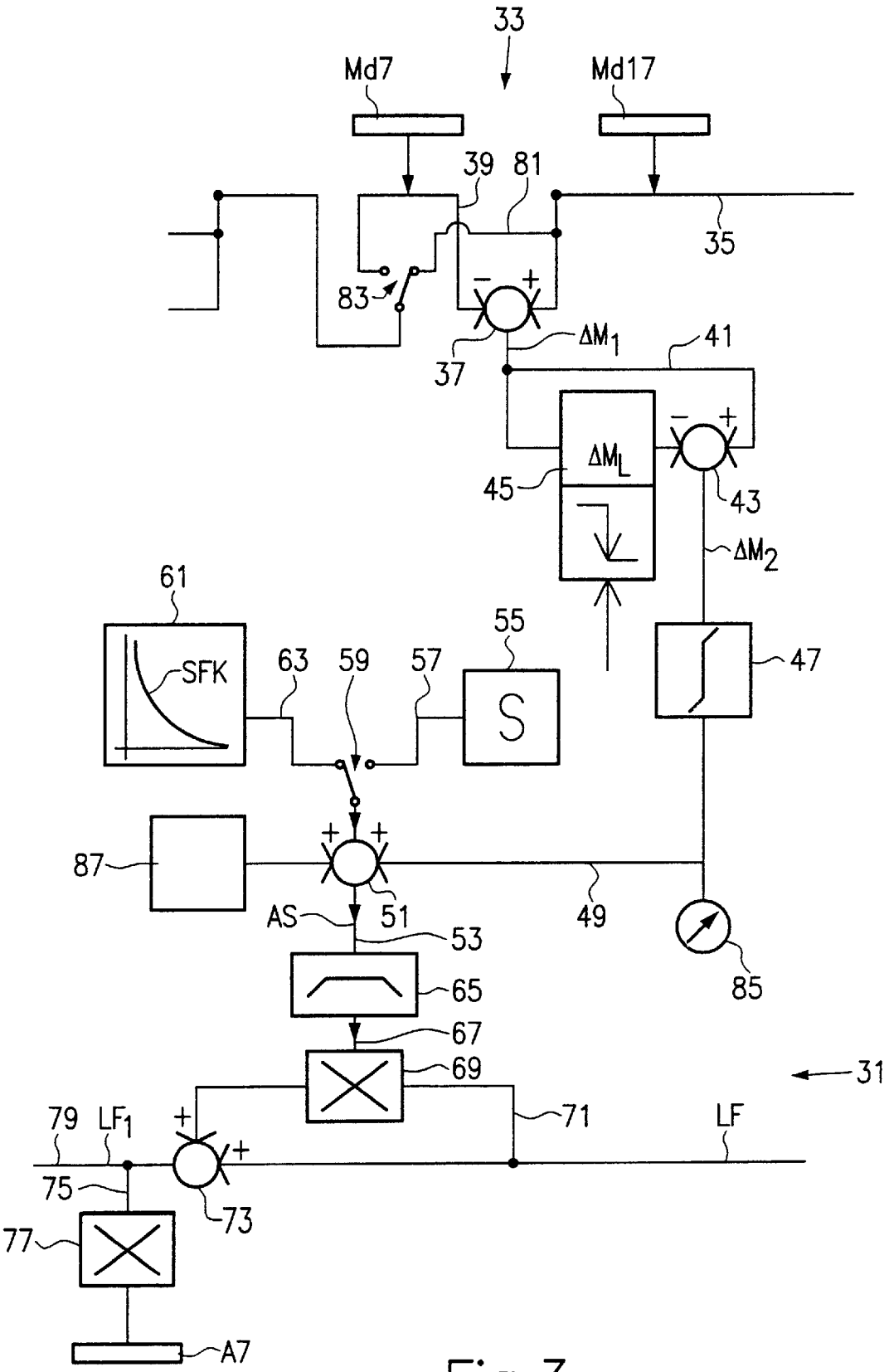
FIG. 3: shows a block diagram of a first preferred repeating portion of a regulating device according to the invention with moment-difference-regulation.

In the regulating device 23, the entire control and regulation of the device 1 according to the invention is performed, with FIG. 3 showing the sequence plan of a regulating device element between two adjacent draw plates. On the basis of FIG. 3, the method according to the invention will be described.

FIG. 3 shows a block diagram 31 of a first embodiment of the regulating device 23, comprising regulating device modules 33, the number of which corresponds to the number of the draw plates 7. In the case of FIG. 3, the regulating module 33 is shown, which is provided for the regulation between the last draw plate 7 and the draw-off plate 17.

The torque of the draw-off plate 17, referred to as Md17, is fed to an addition element 37 via the data line 35. Via a data line 39 the motor torque Md7 of the draw plate 7 is also fed to the addition element 37 and is subtracted in this addition element 37 from the value of the Md17.

The first torque difference value $\Delta M_1$ resulting therefrom is, in accordance with 41 (since it is the matter of a digital drive operating by means of software only, data lines in the physical meaning do no longer exist from this place on), fed to a second addition element 43. A stored reference value $\Delta M_L$ existing in a storage means 45 is compared to the value $\Delta M_1$ in the addition element 43. The result is a second torque difference value $\Delta M_2$. This value is transmitted correspondingly filtered via a dead area element 47 and meets, in accordance with 49, another addition element 51. In the addition element 51 the value $\Delta M_2$ is compared with at least one further value and is then transmitted via 53 as drive nominal value AS. The drive nominal value AS subsequently is fed to a characteristic frequency LF via further elements which will be described later, and is transmitted to the drive A7 of the draw plate 7.

The value AS substantially depends on two influencing values. In block 55, a value S is stored which corresponds to the predetermined slip value after the starting phase. This value S is, in accordance with 57 and a switch 59, fed to the addition element 51.

In a block 61, a time-dependent slip function curve SFK is, as may be gathered, deposited, and a corresponding value is, in accordance with 63 and via the switch 59, fed to the addition element 51. As may be gathered from FIG. 3, the switch 59 is about to make a connection between the block 61 and the addition element 51. The device thus is in starting operation.

The signal AS transmitted from the addition element 51 is processed in an integrating element 65. The integrating element 65 is, however, only switched on when the switch 59 is in the right-hand position not shown in FIG. 3, where it is, in accordance with 57, connected with the block 55.

The signal transmitted from the integrating element 65 is, in accordance with 67, transmitted to a multiplying element 69. In the multiplying element 69, the arriving value AS is multiplied with the characteristic frequency value LF (via 71) and transmitted to another addition element 73. In this addition element, the value resulting from the multiplication of the value AS with the value LF is added to the corresponding LF-value.

The value calculated in the addition element 73 is calipered (in accordance with 75) and is multiplied via a multiplying block 77 with the predetermined comparative value of the speed of rotation (increase of the speed of rotation due to reduction of cross-section and gear ratio), and is subsequently transmitted to the drive A7 of the draw plate 7.

The new characteristic value LF1 transmitted by the addition element 73 is again provided to the adjacent regulating circuit via 79.

As may be gathered from the upper section of FIG. 3, the value Md17 is calipered at the data line 35 and is fed to a switch 83 via a data line 81. The switch 83 serves to interrupt the data flow of the torque value Md17 to the next-front reference value.

In block 85, the value of the re-regulation is indicated, and the possibility of a limitation of the re-regulation can be provided.

In block 87, the possibility of interference by hand is shown schematically.

The method according to the invention is described in the following on the basis of FIG. 3. In particular, the functioning from the beginning of the starting operation and the beginning of the regulation to the full stationary operation of the drawing device is will be described.

On starting of the drawing device, the switch 59 is, as shown in FIG. 3, set. Due to the curve SFK in block 61, one first of all begins, after all draw plates have been started, at high slip, for instance in the range of 50%, but the slip is, in accordance with the curve SFK, quickly reduced.

After reducing the value at which the drawing speed at the draw plate lies at 0.7 to 0.8 m/s, the torque differential values $\Delta M_1$ collected are stored in the storage means 45 as reference values $\Delta M_L$.

Subsequently, the switch 59 is shifted, and a negative slip is fed to the addition element 51. A slip-free drive of all draw plates 7 thus ensues; it is pointed out again that the draw-off plate 19 is principally operated slip-free.

For stabilization of the regulating circuit, the dead area element 47 is provided which comprises a threshold function. Only when the second torque differential value $\Delta M_2$ of a predetermined positive or negative, respectively, threshold value is exceeded or fallen below, the value is transmitted via 49.

The integrating member 65 also serves the stability of the regulating circuit and is activated only on switching over the switch 59 for connection with block 55.

When starting and when achieving the stationary operating condition at preselected maximum speed, the difference of the effective moments between the two adjacent draw plates 7 always is determined. On increase of the difference and lasting of this deviation for more than a certain period, for instance 3 seconds, the machine is re-regulated such that the slow draw plate and all draw plates positioned at the left side thereof are carefully increased in speed, this levelling out the difference at the reference value again. In the opposite case, when the difference becomes smaller, the speed of rotation of the slow draw plates is decreased.

For reasons of regulation technology, a certain lasting state of the deviation of at least 3 seconds is predetermined.

Since it is always only the difference of two adjacent draw plates that is considered, technological modifications relating to the entire device will not influence the regulation. Deviation control thus will only be performed when the difference changes and when it can be assumed that the modification occurs at one of the two drives only.

Furthermore, in the regulating device according to the invention both the actual wire extension between two adjacent draw plates 7 and the exact final diameter of the billet or the wire, respectively, of the drawing machine is represented. Thus, the disadvantage is avoided in a particularly advantageous way that a larger diameter is produced since the last drawing die was subject to corresponding wear. This exact determination of the final diameter of the drawn wire thus may save substantial costs since regularly only the preset diameter as ordered is paid, and, in the case of larger diameter and equal length of the wire on the coil, the surplus of material will be payable by the wire drawer.

Figure 4:
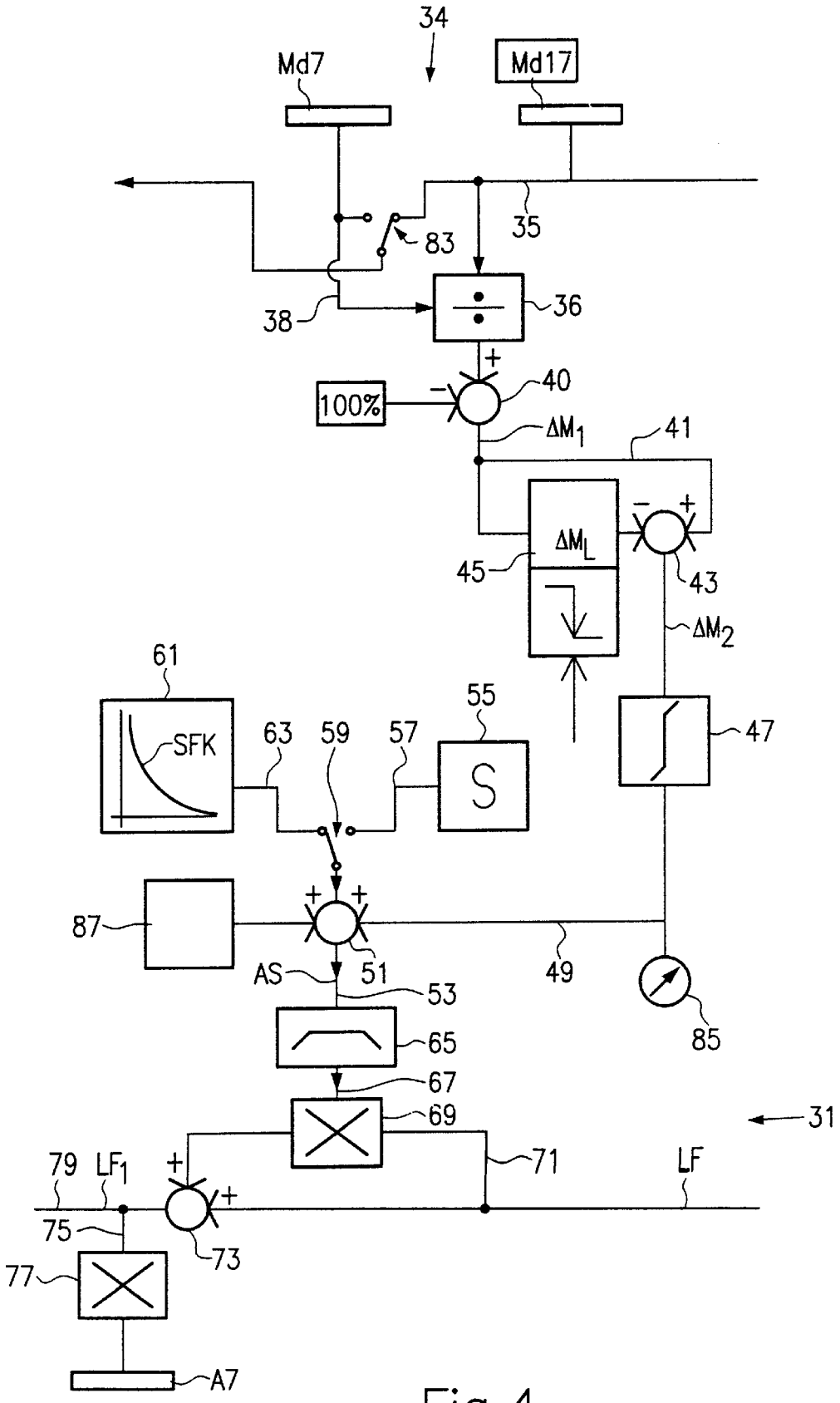
FIG. 4: shows a block diagram of a second preferred repeating portion of a regulating device according to the invention with moment-quotient-regulation.

FIG. 4 shows a preferred alternative configuration of the regulating device. The substantial difference of the regulating device module 34 shown there is to be found in the upper section of FIG. 4. As for the rest, equal parts or components, respectively, have been provided with equal reference numbers.

The torque value Md17 is calipered by the data line 35 and is fed to a quotient block 36. Via a data line 38 the quotient block 36 is supplied with the torque value Md7. In the quotient block 36, the signals then are processed as follows:

$$Md17 \times 100\% / Md7.$$

The result is supplied to an addition block 40, to which a negative value of 100% is added, i.e. subtracted. A standardization to a percentage value thus results, which then forms the first torque comparative value $\Delta M_1$. Subsequently, the same processing as in block diagram 33 of FIG. 3 is performed.

The present invention thus provides both a method of regulating the drive of a drawing machine and a device for drawing billets, in particular wire, by means of which any kind of wires, particularly also copper wires, wires of copper alloys or special materials can be worked. A substantially higher speed of wire drawing is achieved as compared to previous slip-free wire drawing methods, and, due to the exact operating conditions achievable, a striking improvement of the product is obtained by the slip-free drawing. This does not only express itself in the consistency of the material, but also in the corresponding surface quality, the wire drawer in addition having the advantage of being able to exactly determine the diameter of the finished wire, so that non-paid larger diameters can be avoided.

By the possibility of operating the drawing device both with slip and without slip, a universal applicability of the drawing device is achieved, the previous disadvantages of wet drawing being avoided and, in particular, the considerable noise pollution by drawing with slip also ceasing.

With particular advantage, the method in accordance with the invention ensures an automatic regulated slip-free operation performed by the machine itself, which renders the interference of an operating person superfluous. For adjusting the machine, it is merely necessary that the respective drawing die characteristic values be entered; subsequently the drawing device can be operated completely automatically due to the perfect regulation and the automatic follow-up of the drives. Expensive additional equipment such as dancers, jockey rollers, brakes etc. are not necessary, this requiring substantially less efforts and expenses.

What is claimed is:

1. A method of drive regulation for the slide-free operation of a multiple drawing machine or drawing device, respectively, including a plurality of draw plates for drawing a billet, wherein each of said draw plates is drivable by an assigned, separately controllable drive, and wherein drawing dies can be provided between the draw plates, said drawing dies serving to reduce the cross-section and thus extend the material drawn, with particular characteristic values, being automatically taken up or collected, respectively, at each drive, the method comprising the steps of:

a) automatically determining effective torques necessary for a deformation process at individual drawing stages at every starting process at low and constant speed in operation with slip, a reference comparative value ($\Delta M_L$) being formed from the effective torques of every two adjacent draw plates, b) determining the effective torques at the drawing stages in slip-free production operation and forming of a comparison of every two adjacent draw plates for forming a first torque comparative value ($\Delta M_1$) each, c) comparing the collected first torque comparative value ($\Delta M_1$) with the predetermined reference torque comparative value ($\Delta M_L$), and d) in the case of deviations of the current first torque comparative value ($\Delta M_1$) from the reference torque comparative value ($\Delta M_L$), overlapping of the regulation of the speed of rotation of the drives such that the respective slower drive modifies the speed of rotation of the pertinent draw plate until the deviation between the torque comparative values is substantially 0 again.

2. The method according to claim 1, wherein the predetermined value of the slip is negative in the stationary operation of the drawing machine.

3. The method according to claim 1 wherein the regulation of the speed of rotation of the draw plates is performed on the basis of the speed of rotation of the last draw plate and the speed of rotation of the respective draw plate depends on the characteristic nominal value.

4. The method according to claim 1 wherein it is performed with a wet drawing machine.

5. The method according to claim 1 wherein the controllable drives of said draw plates are electric motors, and wherein every drive is fully powered on starting of said drawing machine or drawing device, respectively.

6. The method according to claim 5 wherein the powering of said motors is controlled such that said billet is relaxed on stopping the drawing machine.

7. The method according to claim 1 wherein a distinct slip is provided for on starting, which is quickly reduced strongly, with minor line speed of the billet being provided.

8. The method according to claim 1 wherein the starting of the machine is performed from the minor line speed to the operating speed in slip-free operation.

9. The method according to claim 1 wherein the predetermined slip value is, at least for all draw plates, the speed of rotation of which is regulated as a function of the comparative value, equal.

10. The method according to claim 1 wherein the negative slip value amounts to at least −0.1%.

11. The method according to claim 1 wherein the drive positioned first in drawing direction is exempted from the regulation.

12. The method according to claim 1 wherein the friction characteristic values are automatically determined during idling and are stored as correcting values.

13. The method according to claim 1 wherein the first torque comparative value ($\Delta M_1$) is formed from the difference of two torques of adjacent draw plates.

14. The method according to claim 1 wherein the first torque comparative value ($\Delta M_1$) is formed from the quotient of two torques of adjacent draw plates.

15. The method according to claim 14 wherein the quotient value is standardized to form a percentage value ($(M_i \times 100\%/M_{i-1})-100\%$).

16. A device for drawing a metal billet, comprising:

a plurality of draw plates which are driven individually by means of drive means and around which the billet is guided in operation; and a plurality of drawing dies positioned between said draw plates and serving to reduce the cross-section of the billet and to correspondingly extend the billet;

a regulating means wherein the regulating means a) automatically determines a effective torque necessary for a deformation process at the individual drawing stages at every starting process at low and constant speed in operation with slip, a reference torque comparative value ($\Delta M_L$) being formed from the effective torques of every two adjacent draw plates, b) collects the effective torques at the drawing stages in slip-free production operation and compares the effective torques of every two adjacent draw plates for forming a first torque comparative value ($\Delta M_1$) each, c) compares the collected first torque comparative value ($\Delta M_1$) with the predetermined reference torque comparative value ($\Delta M_L$), and d) in the case of deviations of the current first torque comparative value ($\Delta M_1$) from the reference torque comparative value ($\Delta M_L$), overlaps a regulation of the speed of rotation of the drives such that a respective slower drive modifies the speed of rotation of the pertinent draw plate until the deviation between the torque comparative values is substantially 0 again.

17. The device according to claim 16 that is configured as wet drawing machine.

18. The device according to claim 16 wherein the drives of the draw plates comprise electric motors, and wherein every drive is fully powered on starting of the device.

19. The device according to claim 16 wherein a distinct slip between billet and draw plate prevails on starting, which is strongly reduced, with a starting speed prevailing.

20. The device according to claim 16 that performs the running up to maximum operating speed in slip-free operation.

21. The device according to claim 16 wherein a the predetermined slip value is, for all draw plates, the speed of rotation of which is regulated as a function of the comparative value, equal.

22. The device according to claim 16 wherein a negative slip value preferably amounts to at least −0.1%.

23. The device according to claim 16 wherein the drive positioned first in drawing direction is not regulated.

24. The device according to claim 16 wherein the regulating means collects friction characteristic values during idling in said device.

25. The device according to claim 16 wherein the regulating means automatically determines the torque comparative values anew and automatically adapts the drives to modified material to be drawn.

26. The method according to claim 7, wherein said minor line speed of the billet ranges below 5% of the maximum speed.

27. The device according to claim 19, wherein said starting speed is lower than 5% of the maximum speed.

28. The device according to claim 16, wherein the metal billet is a round wire or a profile wire.

* * * * *